US005908323A

United States Patent [19]

Seidler

[11] Patent Number: 5,908,323

[45] Date of Patent: Jun. 1, 1999

[54] ZERO INSERTION FORCE CONNECTOR

[75] Inventor: Jack Seidler, Flushing, N.Y.

[73] Assignee: North American Specialties Corporation, Flushing, N.Y.

[21] Appl. No.: 08/806,446

[22] Filed: Feb. 26, 1997

[51] Int. Cl.[6] ..... H01R 11/22

[52] U.S. Cl. ..... 439/266; 439/267

[58] Field of Search ..... 439/266, 267, 439/268, 269.1, 269.2, 874, 876, 342

[56] References Cited

U.S. PATENT DOCUMENTS 3,710,303 1/1973 Gallager, Jr. ..... 439/267
4,503,609 3/1985 Mackay ..... 439/876

*Primary Examiner*—Gary Paumen
*Attorney, Agent, or Firm*—Darby & Darby

[57] ABSTRACT

A zero-insertion force connector having a frame which includes a selectively deformable base. Contacts are supported by the base and are selectively displaced from an insertion path when the base is deformed, allowing insert elements, such as wire from flat cable, or a printed circuit board, to be inserted between the contacts without substantial resistance. Releasing the force which is deforming the base allows the base to return to its rest shape under a natural resiliency of the material used to make the base, which causes the contacts to move against the inserted element and establish electrical communication.

20 Claims, 3 Drawing Sheets

ZERO INSERTION FORCE CONNECTOR

FIELD OF THE INVENTION

This invention relates to a zero insertion force (ZIF) connector generally used on a printed circuit board for receiving a secondary printed circuit board (e.g., a "daughter card") or used to receive a flexible flat cable (FFC).

BACKGROUND OF THE INVENTION

A conventional ZIF connector typically includes a housing having an elongated slot along a front surface which is sized and shaped to receive a circuit board or flexible flat cable (hereinafter called insert elements). Located within the housing are typically a plurality of terminals which are adapted to contact at least one surface of the insert element. The terminals are biased to a predetermined overlapping position and will therefore exert a controlled amount of contact force against the insert element to achieve the required electrical contact. As is well known in the art, many of the circuit boards and flat cable used today are delicate and include fragile electrical contacts, such as thin film deposition layers and high gauge wire (extremely fine). Such delicate insert elements are easily damaged during insertion into the slot of a ZIF connector even by the relatively low contact force exerted by the terminals. It is for this reason that ZIF connectors include provisions to reduce the magnitude of the contact force during insertion of the insert elements and thereafter reapply the force so that proper electrical contact may be achieved. A common technique used with prior art ZIF connectors to release or reduce the contact force of the contact terminals during insertion of the inserted elements is to mechanically displace each contact terminal from the path of insertion, during the insertion process. This displacement of terminals may be achieved using a lever arm which mechanically engages each contact terminal, or, as in the connector disclosed in U.S. Pat. No. 5,542,855 issued to Asai, the contact terminals are already positioned away from the path of insertion during the insertion process and are forced into tight engagement, as required, by inserting a key element into a second slot which effectively deforms each contact terminal in the desired manner.

A problem with the prior art ZIF connectors is that they are expensive to manufacture owing to the relatively complex internal mechanisms used to simultaneously displace the contact terminals. These prior art ZIF connectors are designed for repeated use, such as removably securing an IC chip to a circuit board for possible removal at a later time. The prior art ZIF connectors are not intended to be permanently attached (soldered) to both the inserted elements and the circuit board.

It is therefore a first object of the present invention to provide a zero-insertion-force connector which is simple in construction and inexpensive to manufacture.

It is another object of the invention to provide such a ZIF connector that includes contacts that are adapted to be soldered to corresponding electrical contacts located on the insert element.

It is another object of the invention to provide such a ZIF connector that otherwise overcomes the deficiencies of the prior art.

SUMMARY OF THE INVENTION

A zero-insertion force connector having a frame which includes a selectively deformable base. Contacts are supported by the base and are selectively displaced from an insertion path when the base is deformed, allowing insert elements, such as wire from flat cable, or a printed circuit board, to be inserted between the contacts without resistance. Releasing the force which is deforming the base allows the base to return to its rest shape (under a natural resiliency of the material used to make the base), which causes the contacts to move against the insert element and establish electrical communication.

In one embodiment, the applied force causes a portion of the frame to deform away from each contact. In other embodiments, the applied force causes the contacts to deform away from each other or away from a portion of the frame.

In any case, each contact includes a head which may include a solder bead (together with flux) that may be later heated to establish a permanent electrical connection.

Other features and advantages inherent to the present invention will be better understood from the accompanying drawings when read in conjunction with the following detailed description.

DETAILED DESCRIPTION OF THE PREFERRED EMBODIMENT

Figure 1C:
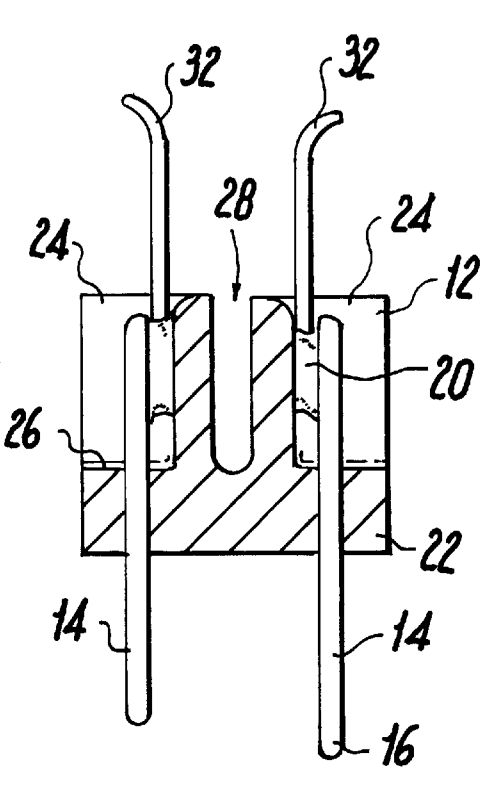
FIG. 1C is a sectional side view of the ZIF connector of FIG. 1A showing the contacts located in a closed and contacting position with respect to the frame and soldered to the insert element, according to the first embodiment of the invention.
Figure 1B:
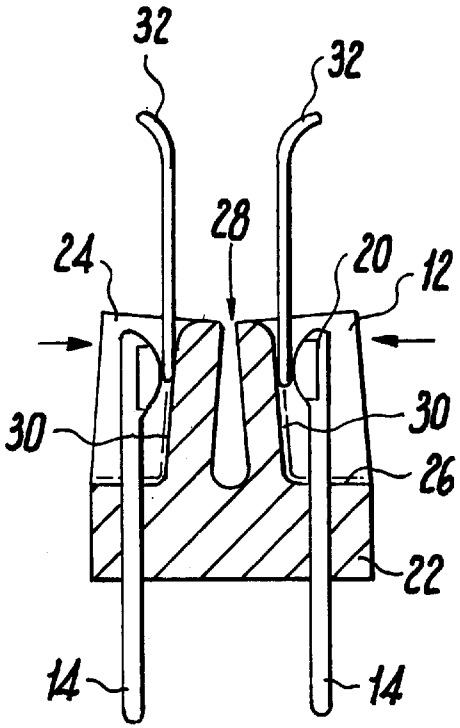
FIG. 1B is a sectional side view of the ZIF connector of FIG. 1A showing the contacts in a receiving position with respect to a deformed frame, during insertion of an insert element, according to the first embodiment of the invention.
Figure 1A:
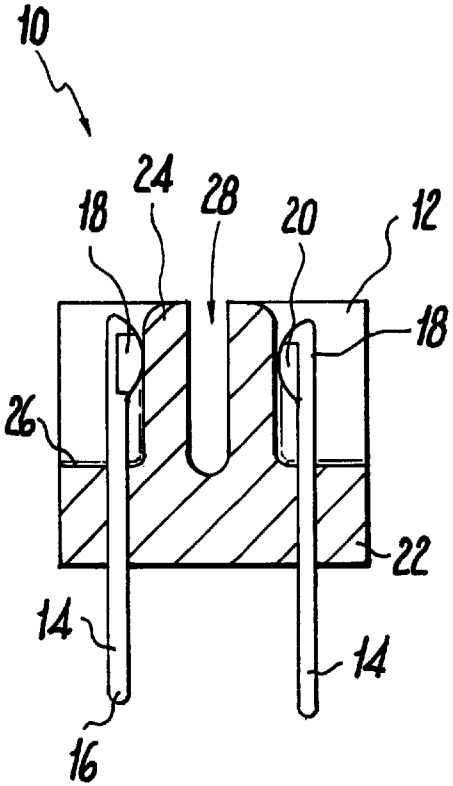
FIG. 1A is a sectional side view of a ZIF connector according to a first embodiment of the invention, showing contacts in a closed position with respect to a frame and prior to insertion of an insert element.

Referring to FIGS. 1A, 1B and 1C, a zero insertion force connector (a ZIF connector) 10 is shown, according to a first embodiment of the invention. ZIF connector 10 includes a frame structure 12 which supports at least one contact 14. Frame structure 12 is shown in a non-deformed position in FIG. 1A, a deformed position in FIG. 1B, and a rest position in FIG. 1C.

Each contact 14 includes an arm 16 and a head 18. As is well known in the art, head 18 and arm 16 of contact 14 are made from an appropriate electrically conductive and resilient material, such as copper or gold. Head 18 preferably includes a predetermined amount of solder 20 including an appropriate type and quantity of flux. Frame 12 is made from any resilient insulative material, such as most plastics including Nylon, high and low density polypropylene and polyethylene, liquid crystal polymer, other thermoplastics, rubber, and rubber-based compounds. Frame 12 must possess resilient characteristics such that it may be deformed without permanent damage to its structure, allowing the frame structure to create a resilient spring bias to return to its original shape.

Frame 12 is preferably made using an injection molding technique, as is well known in the art, and includes a base 22 having two parallel projections 24 extending from an upper surface 26, preferably formed integrally with base 22. Projections 24 are formed adjacent to each other at a predetermined distance, and therefore define a slot 28 therebetween, and include a contact surface 30. Each contact 14 is supported by base 22 of frame 12 and projects upwardly, perpendicular with respect to upper surface 26, so that each head 18 of contact 14 lies generally parallel and adjacent to each respective contact surface 30 (when frame 12 is in its non-deformed position, as shown in FIG. 1A). An insert element 32, either wire, printed circuit board, or any conductive material, may be inserted along an insertion path which passes between each head 18 and each respective contact surface 30. Insert element 32 may be inserted along the insertion path following an insertion process, described below.

In operation of this first embodiment, referring to FIG. 1B, an inwardly directed force may be selectively applied to opposing sides of frame 12 on each projection 24. The force (which is represented by arrows in FIG. 1B, is directed along an axis which is generally parallel to upper surface 26 of base 22, and perpendicular to each projection 24). The applied force is sufficient to deform the projections 24 toward each other so that slot 28 is reduced thereby causing each projection 24 to move inwardly away from each respective head 18 of each contact 14, which remain perpendicular to upper surface 26. As the inwardly directed force is applied as shown in FIG. 1B and as described above, each contact surface 30 moves away from each respective head 18 a sufficient distance to accommodate insert element 32. Insert element 32 does not substantially come into contact with contact surface 30 and head 18 as it moves along the insertion path to a position located between head 18 and contact surface 30.

Once insert element 32 is properly inserted in between each head 18 and its respective contact surface 30, the applied force may be released (or reduced) so that the natural resiliency inherent in the material used to make frame 12 causes frame 12 to return to its originally molded shape (shown in FIG. 1A). As applied force is reduced, the resiliency of projections 24 causes them to move outwardly, opening slot 28 and transversely forcing newly inserted insert element 32 into tight contact with adjacent head 18. Head 18 may be sufficiently heated, as known in the art, to melt solder bead 20 to permanently bond inserted element 32 with each respective head 18, ensuring a strong electrical contact between the two.

Figures 2A, 2B, 2C:
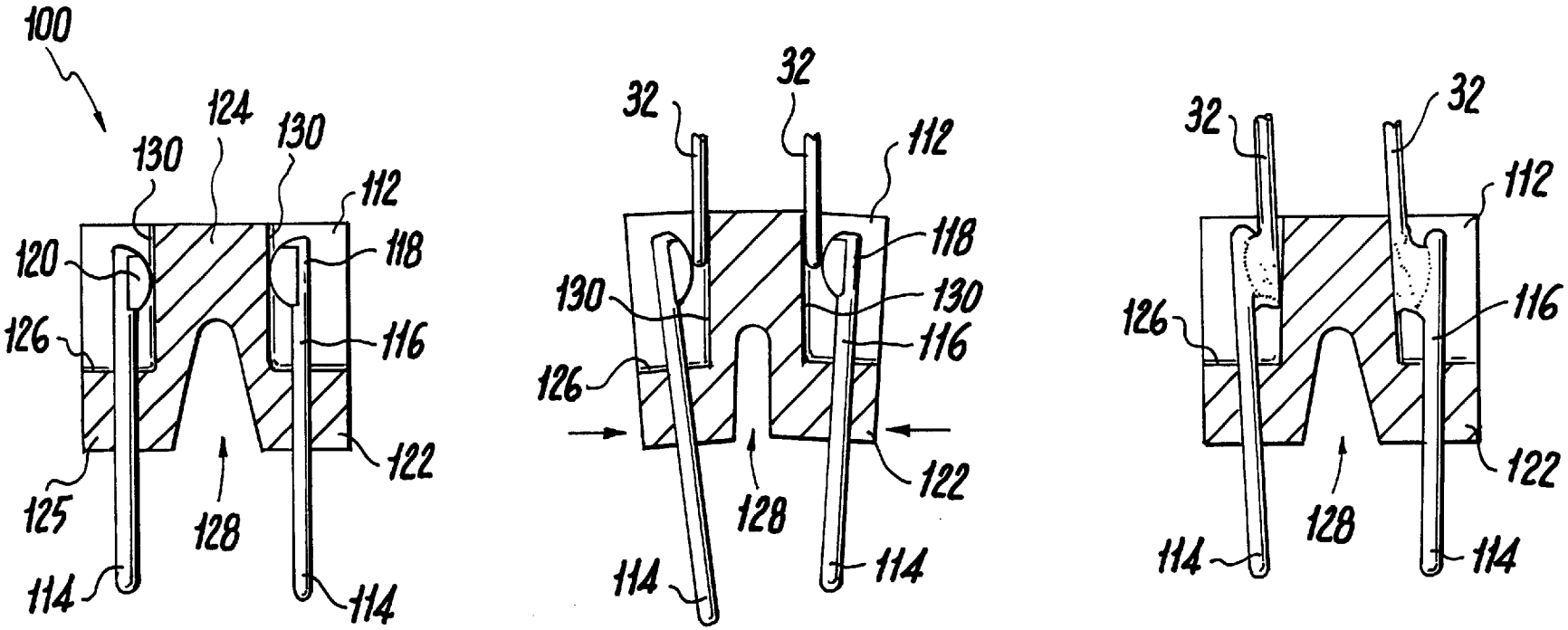
FIG. 2A is a sectional side view of a ZIF connector having a deformable frame and contacts, showing the frame in a pre-deformed position and the contacts in a pre-insertion position, according to a second embodiment of the invention.
FIG. 2B is a sectional side view of the ZIF connector of FIG. 2A showing the frame in a deformed position and the contacts located in a receiving position, according to the second embodiment of the invention.
FIG. 2C is a sectional side view of the ZIF connector of FIG. 2A showing the frame and the contacts in a rest position and the contacts soldered to an inserted element, according to the second embodiment of the invention.

Referring now to FIGS. 2A, 2B, and 2C, a ZIF connector 100, according to a second embodiment is shown having frame 112, contacts 114 including head 118 and arm 116. A base 122 of frame 112 supports each contact 114 perpendicularly upward, as in the first embodiment described above. Projecting upward from base 122 is a single projection 124 which includes contact surfaces 130 that are sized and shaped to contact against each respective head 18 of contacts 14, as in the above-described embodiment. The bottom portion of projection 124 is split into two downward projections 125, which form a slot 128 therebetween. One difference of this second embodiment is that slot 128 is directed downward into base 122, not upward and adjacent projection 124.

In operation of the ZIF connector 110, according to the second embodiment of the invention, an inwardly directed force is applied to frame 112, along its base 122 (as shown by arrows in FIG. 2B). The force is applied along an axis which is generally parallel to the upper surface 126 of downward projections 125 and perpendicular to projection 124 and slot 128. The result of applying the force is that base 122 deforms (curves upwardly) as slot 128 is reduced under the influence of the inwardly directed force. The deformation of base 122, which is shown in FIG. 2B, causes each arm 116 of each contact 114 to move away from contact surface 130 of projection 124 thereby allowing insert element 132 to be freely inserted without resistance along an insertion path located between each head 20 and each respective contact surface 130.

Once insert element 132 is properly positioned between contact 114 and respective contact surface 130, the applied force may be released, which causes base 122 to return (under its natural resiliency) to its rest position (shown in FIG. 2A). As base 122 returns to its rest position, slot 128 opens and heads 118 move toward each other transversely forcing insert elements 132 into tight contact with adjacent and respective contact surfaces 130, as shown in FIG. 2C. Solder beads 120 may be heated, as described above, to permanently bond each insert element 132 to each respective contact 114.

Figure 3C:
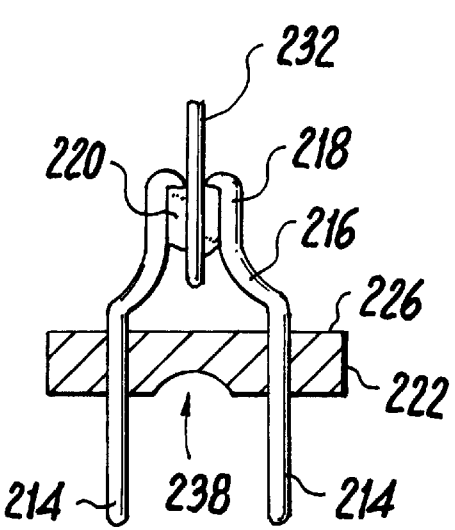
FIG. 3C is a sectional side view of the ZIF connector of FIG. 3A showing the frame in a rest position and the contacts permanently bonded (soldered) to the inserted element, according to the third embodiment of the invention.
Figure 3B:
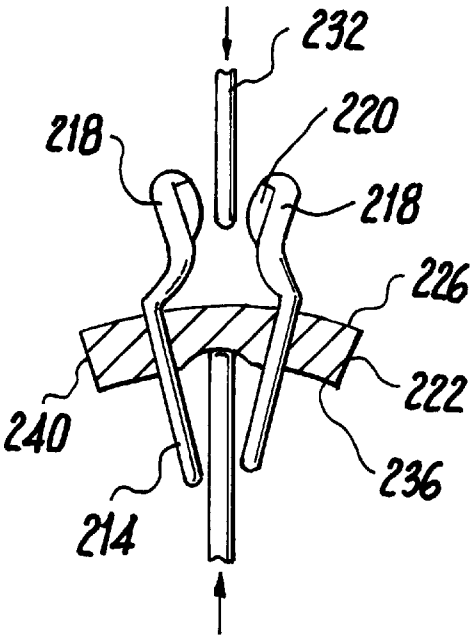
FIG. 3B is a sectional side view of the ZIF connector of FIG. 3A showing the frame being deformed and the contacts in a receiving position, according to the third embodiment of the invention.
Figure 3A:
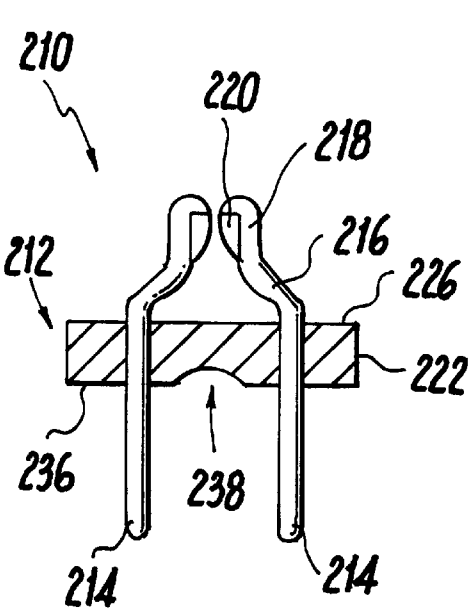
FIG. 3A is a sectional side view of a ZIF connector having a deformable frame and contacts, showing the frame in a pre-deformed position and the contacts in a pre-insertion position, according to a third embodiment of the invention.

Referring now to FIGS. 3A, 3B, and 3C, a ZIF connector 210 according to a third embodiment is shown including a frame 212 which comprises a base 222 which is generally flat and includes an upper surface 226 and a lower surface 236. Contacts 214, as in the above described embodiments, are supported by base 222 and include arms 216 and heads 218. Each head 218 includes a solder bead 220. This embodiment does not include a projection similar to projection 24 located between heads 218. Accordingly, heads 218 contact each other (or are separated by a very small gap), as shown in FIG. 3A, or are arranged in an alternating overlapping arrangement slightly displaced along the axis perpendicular to FIG. 3A. Located between contacts 214 (approximately at a midpoint of base 222), along lower surface 236 is an upwardly directed groove or detent 238. Groove 238 may extend the entire length of frame 212 and is used to aid in deforming base 222 during the insertion process.

In operation of this third embodiment, a force is applied upwardly within groove 238 and therefore between contacts 214, as two opposing forces are simultaneously applied to a portion of upper surface 226 of base 222 located outside both contacts 214, adjacent to an edge 240 of base 222 and remote from the upwardly directed force. The combination of applied forces to base 222 results in base 222 deforming in an upwardly directed and curved manner, similar to the above-described second embodiment.

The deformation of base 222 causes both contacts 214 to angle outwardly (remaining perpendicular to now curved upper surface 226). The outward separation of contacts 214 causes heads 218 to separate, thereby defining an insertion space into which insert elements 232 may be inserted without contacting heads 218, as shown in FIG. 3B.

As before, once insert elements 232 are inserted between heads 218, the applied forces may be removed so that base 222 may return to its straight flat shape (under the natural bias of its own resiliency). This causes opposing heads 218 to move toward each other and tightly retain insert element 232. As discussed, above, solder beads 220 of heads 218 may be appropriately heated to permanently bond each contact 214 with a corresponding contact located on insert element 232, as is known in the art.

This third embodiment is particularly suitable for securing ZIF connector 210 to a printed circuit board.

What is claimed is:

1. A zero-insertion-force connector for receiving an electrically conductive insert element, comprising:

a frame having a base and a contact surface extending upwardly from said base;

at least one contact supported by said base and having a head which lies generally adjacent to said contact surface;

said base comprising a resilient material which is selectively deformable such that said head and said contact surface may be temporarily displaced from each other such that an insert element may be inserted between said contact surface and said head without substantial contact with said contact surface and said head; and wherein said resilient material of said base selectively returns said base to an original shape such that said head and said contact surface move toward each other and force said insert element against said head to establish electrical connection therebetween.

2. The zero-insertion-force connector according to claim 1, wherein said base is made from a resilient plastic.

3. The zero-insertion-force connector according to claim 2, wherein said base is formed using a liquid crystal polymer.

4. The zero-insertion-force connector according to claim 1, wherein said base, frame and contact surface are formed integrally.

5. The zero-insertion-force connector according to claim 4, wherein said frame, base and contact surface are integrally formed from a strong resilient plastic.

6. The zero-insertion-force connector according to claim 1, wherein said head further comprises a bead of solder which may be selectively melted to bond said insert element to said contact.

7. The zero-insertion-force connector according to claim 6, including means for melting said bead of solder to said insert element to bond said contact to said insert element.

8. A zero-insertion-force electrical connector for receiving an electrically conductive insert element, the connector comprising:

a frame having a base and at least one projection attached to and extending from said base, said projection having a contact surface, at least one contact supported by said base, said contact having a head which lies generally adjacent to said contact surface, said projection being selectively deformable against a biasing force such that said head and said contact surface may be temporarily displaced from each other thereby defining an intervening space, said intervening space being adapted to receive said insert element without substantial contact with said contact surface and said head; and wherein said biasing force selectively returns said projection to an original shape such that said head and said contact surfaces move toward each other and force said insert element against said head to establish electrical connection therebetween.

9. The zero-insertion-force connector according to claim 8, wherein said biasing force is provided by the natural resiliency of the base.

10. The zero-insertion-force connector according to claim 9, wherein said base is made from a strong resilient plastic.

11. The zero-insertion-force connector according to claim 10, wherein said base is formed using a liquid crystal polymer.

12. The zero-insertion-force connector according to claim 8, wherein said base, frame and contact surface are formed integrally.

13. The zero-insertion-force connector according to claim 12, wherein said frame, base and contact surface are integrally formed from a strong resilient plastic.

14. The zero-insertion-force connector according to claim 8, wherein said head further comprises a bead of solder which may be selectively melted to bond said insert element to said contact.

15. The zero-insertion-force connector according to claim 14, including means for melting said bead of solder to said insert element to bond said contact to said insert element.

16. The zero-insertion-force connector according to claim 1, wherein said frame includes at least one upward facing projection with said contact surface thereon and wherein a force is applied to said projection to displace said projection from said contact.

17. The zero-insertion-force connector according to claim 1, wherein said frame includes at least one upward facing projection with said contact surface thereon and wherein a force is applied to said contact to displace said contact from said projection.

18. A zero-insertion-force connector for receiving an electrically conductive insert element, comprising:

a resilient frame;

at least two contacts supported by said frame, each contact having an upper head portion with a contact surface and a lower portion, said contact surfaces being in close proximity;

said frame being selectively deformable such that said contact surfaces supported thereon are temporarily displaced from each other such that an insert element may be inserted therebetween without substantial contact with said contact surfaces; and wherein said frame is returned to its original shape such that said contact surfaces retain said insert element therebetween.

19. A method of inserting an electrically conductive insert element in a zero-insertion-force connector including a deformable frame having a contact surface extending therefrom that is deformable against a biasing force and an adjacent contact, comprising the steps of:

deforming said frame against a spring bias such that said contact surface moves away from said contact and thereby defines a space therebetween;

inserting said electrically conductive insert element into said space without substantially contacting said contact surface;

restoring said frame such that said contact surface is moved by said biasing force such that said insert element is brought into electrical contact with said contact.

20. The method according to claim 19, wherein said contact includes a bead of solder, said method further comprising the step of melting said solder bead to physically and electrically bond said contact to said insert element.

* * * * *